United States Patent [19]

Kozuki et al.

[11] Patent Number: 4,538,500

[45] Date of Patent: Sep. 3, 1985

[54] APPARATUS FOR PRINTING OUT GRAPHICAL PATTERNS

[75] Inventors: Koichi Kozuki, Hamamatsu; Tatsuhiro Koike, Hamakita, both of Japan

[73] Assignee: Nippon Gakki Seizo Kabushiki Kaisha, Hamamatsu, Japan

[21] Appl. No.: 525,607

[22] Filed: Aug. 22, 1983

[30] Foreign Application Priority Data

Aug. 25, 1982 [JP] Japan ..... 57-147230

[51] Int. Cl.[3] ..... G10G 3/04

[52] U.S. Cl. ..... 84/462

[58] Field of Search ..... 84/462; 346/33 R; 400/116, 117

[56] References Cited

U.S. PATENT DOCUMENTS 3,926,088 12/1975 Davis et al. ..... 84/462

*Primary Examiner*—L. T. Hix
*Assistant Examiner*—Douglas S. Lee
*Attorney, Agent, or Firm*—Spensley Horn Jubas & Lubitz

[57] ABSTRACT

A musical score printing apparatus comprises: storing means for storing a musical score data; read-out controlling means for successively reading out the musical score data from the storing means; converting means for converting the musical score data read out from the storing means to a musical score print and paper feed data; and printing means for printing out the musical score on a printing sheet based on the musical score print and paper feed data delivered from the converting means, wherein arrangement is so provided that where printing of a musical score is suspended at halfway of a measure block and thereafter a reprint command is given, the printing of the musical score is resumed from the beginning of the measure block in which the suspension of the printing has been taking place.

6 Claims, 12 Drawing Figures

FAMILY

| | | | | | | | | |
|---|---|---|---|---|---|---|---|---|
| MAJOR | C | G | D | A | E | B | F♯ | C♯ |
| MINOR | A | E | B | F♯ | C♯ | G♯ | D♯ | A♯ |

♭ FAMILY

| | | | | | | | | |
|---|---|---|---|---|---|---|---|---|
| MAJOR | C | F | B♭ | E♭ | A♭ | D♭ | G♭ | C♭ |
| MINOR | A | D | G | C | F | B♭ | E♭ | A♭ |

APPARATUS FOR PRINTING OUT GRAPHICAL PATTERNS

BACKGROUND OF THE INVENTION (a) Field of the invention

The present invention relates to a printing apparatus which is suitable for printing out, for example, a musical score in making a musical composition, or in exercising a performance.

(b) Description of the prior art

In the conventional printing apparatus of the above-mentioned type, there has been the inconvenience that, when a once-suspended printing operation is resumed, the printing is started at a position contiguous to the position at which the printing has been suspended, so that no satisfactory print is obtained at the junction of prints.

SUMMARY OF THE INVENTION

A principal object of the present invention is to provide a printing apparatus which permits a correct and clear print to be obtained by arranging so that the print-resuming position can be designated.

A specific object of the present invention is to provide a novel printing apparatus which is capable of resuming a printing operation at a position with an appropriate leave-off spacing.

Another object of the present invention is to provide a novel apparatus for printing out a musical score, which is capable of resuming the printing operation at an appropriate bar line position.

Still another object of the present invention is to provide an apparatus for printing out a musical score, which is arranged to be able to designate the print-resuming position with an appropriate spacing such as at the beginning of a measure, and which, in case the printing operation is suspended midway of a measure, the printing operation can be resumed by returning to the beginning of the measure or of a measure block, whereby the conventionally encountered poor print occurring at the junction of prints is avoided and also a generally accurate and clear print of a musical score can be obtained.

The apparatus for printing out a graphical pattern which is arranged for the purpose of attaining the principal object of the present invention comprises:

means for successively receiving a data signal representing consecutive discrete blocks of graphical patterns;

memory means connected to the receiving means to store a data portion contained in said data signal and constituting at least one of said discrete blocks of graphical patterns;

read-out means connected to said memory means to timewisely successively read out said data portion stored in said memory means;

printing means connected to said read-out means to timewisely successively print out a graphical pattern on a recording sheet in accordance with the data portion being read out from said memory means;

first controlling means connected to said read-out means and to said printing means to suspend the print-out operation at a point midway of one of said discrete blocks of graphical pattern;

resumption commanding means to command to resume the suspended print-out operation; and second controlling means connected to said resumption commanding means, to said read-out means and to said printing means to cause to resume the print-out operation at least from the beginning of said discrete block of graphical pattern containing said point at which the print-out operation has been suspended, in accordance with a resumption command delivered from said resumption commanding means.

DETAILED DESCRIPTION OF THE PREFERRED EMBODIMENTS

Figure 1:
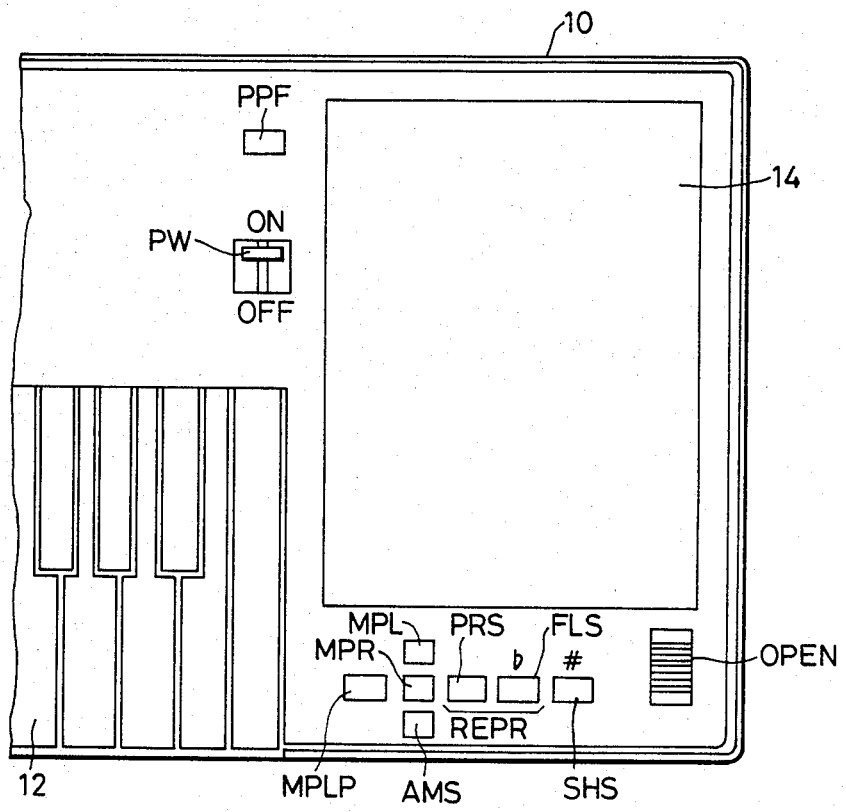
FIG. 1 is a diagrammatic plan view, partly broken away, showing a part of the electronic musical instrument provided with a musical score printing apparatus according to one embodiment of the present invention.

FIG. 1 shows a part of an electronic musical instrument provided with a musical score printing apparatus according to one embodiment of the present invention. Reference numeral 10 represents the body of the musical instrument; 12 a keyboard; and 14 a printer section. Also, symbol PW represents a power supply switch; PPF a paper feed switch; OPEN a switch for opening the cover panel of the printer section; SHS a tonality setting switch for the sharp family tonalities (keys); FLS a tonality setting switch for the flat family tonalities; PRS a print stop switch for immediately suspending a printing operation; MPL a lock type memory play switch for storing a performance data in a memory; MPR a memory print switch for printing out the performance data stored in the memory; AMS a correction switch for commanding correction of duration data; and MPLP a lock type memory play print switch both for storing the performance data in the memory and for printing out the stored data. The print stop switch PRS and the tonality setting switch for the flat families are inter-relatedly arranged so that, when these two switches are operated simultaneously, they act as a reprint command switch PEPR. This arrangement saves the switch-locating area for such an amount as would otherwise be required for the installment of an exclusive print command switch. In the following statement, however, description will be made with the assumption that, for convenience' sake, an independent reprint command switch is provided.

Figure 2:
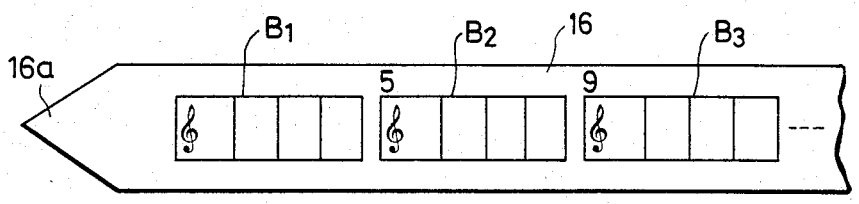
FIG. 2 is a diagrammatic plan view showing a part of a printing paper sheet with printed measure blocks of a musical score.
Figure 3:
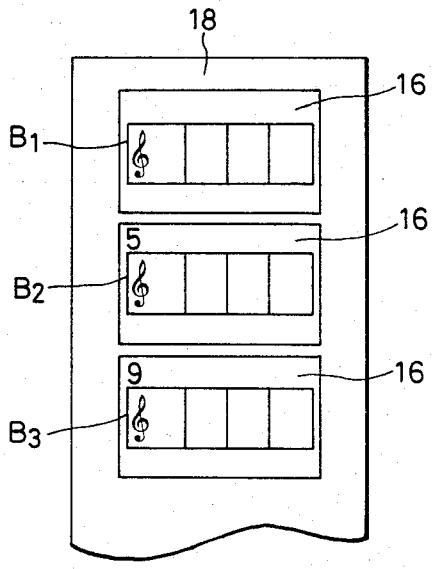
FIG. 3 is a diagrammatic plan view showing an example of a patched arrangement of the printed-out measure blocks.

FIG. 2 shows a laterally oblong (continuous as a roll) printing paper sheet 16, the forward end 16*a* of which is of a pointed (an arrowed) shape for its easy mounting on the printer section. On the printing paper sheet 16 is printed a musical score in serial sequence using every four measures to constitute one measure block, in such manner that, in the vicinity of the respective leading measures of the second and subsequent measure blocks $B_2$, $B_3$, . . . excepting the 1st measure block $B_1$, the measure numbers such as "5", "9", . . . are printed out. By providing measure numbers as stated above, it becomes very convenient for the user in severing apart the printing paper sheet 16 after completion of a printing operation for every measure block to vertically rearrange them on a mounting board 18 as shown in FIG. 3, because the order of the measure blocks thus arranged can be recognized at a glance.

Figure 4A:
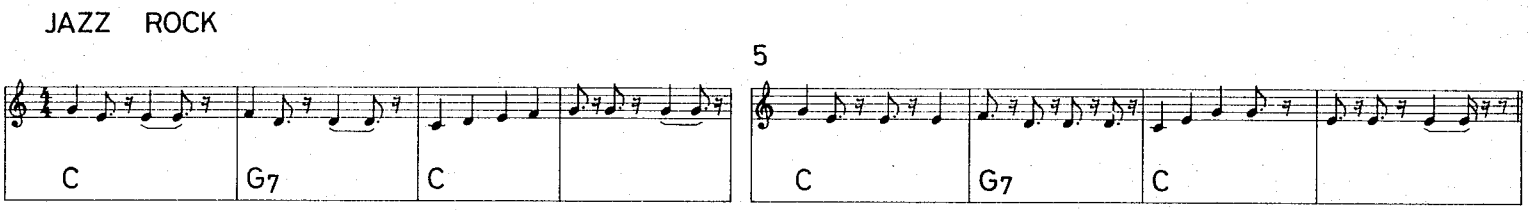
FIGS. 4*a* and 4*b* are illustrations showing examples of prints obtained by the abovesaid musical score printing apparatus.
Figure 4B:
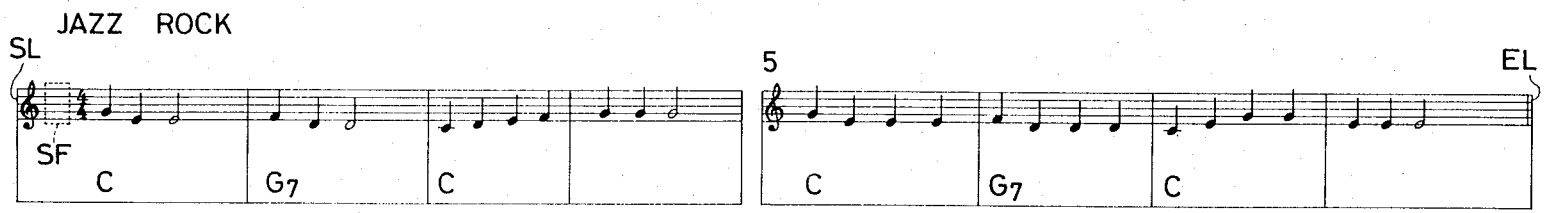

FIGS. 4*a* and 4*b* show examples of the prints obtained by the abovesaid musical score printing apparatus. The printing operation will hereunder be briefed by giving reference to these figures. It should be understood that the printing operation is carried out in case of a memory-play-and-print mode when the memory-play-and-print switch MPLP is operated, and also in case of a memory print mode when the memory print switch MPR is operated.

FIG. 4*a* shows an example of print obtained in case the duration data correction processing which will be described later is not made. FIG. 4*b* shows an example of print obtained in case the duration data correction processing is made.

As shown in FIG. 4*b*, after the first bar line SL and the staff lines for the lst measure have been printed out, a clef sign such as G clef as well as a time signature such as 4/4 are printed out. In case of a musical composition requiring a tonality signature, the tonality signature is printed out at a position shown by a surrounding broken line SF in accordance with the tonality setting done by the abovesaid tonality setting switch SHS or FLS, and thereafter the printing of items subsequent to the first bar line SL is started.

Next, notes, including rests if any, for the lst measure are printed out on the already printed out staff lines of the lst measure in accordance with the contents of the performance. Also, such accidental signatures as "tie", "natural", "sharp" and "flat" are printed out as required. When the printing operation comes to the end of the 1st measure, the bar line and the staff lines for the 2nd measure are printed out, and thereafter the notes (rests) of the 2nd measure are printed out in accordance with the contents of the performance. Similar printing operations are carried out for the 3rd and 4th measures.

Subsequently, when the printing operation comes to the end of the 4th measure, the bar line at the finish of the 4th measure is printed out. In this case, however, the bar line for the 5th measure is not printed out yet. Then, after taking a leave-off space by a feed of the printing sheet, the tonality signature for the 5th measure is printed out if the tonality is other than C major, and furthermore the initial bar line of the 5th measure and the staff lines are printed out, along with the clef signature. Then, the notes for the 5th measure are printed out. Thereafter, for the 6th to 8th measures also, the printing operations similar to the 2nd measure are carried out.

In case the performance is to be finished at the end of the 8th measure, a finish line EL is printed out at the end position of the 8th measure.

In FIGS. 4*a* and 4*b*, arrangement is made so that a rhythm name such as "JAZZ ROCK" and a chord name such as "C", "$G_7$" and so forth are printed out. In the apparatus which will be described as an embodiment, there is omitted the arrangement concerning the function of printing these items.

Next, the circuit operation of the abovesaid musical score printing apparatus will be described by referring to FIGS. 5*a* to 7.

A keyboard circuit 20 includes a keyboard, and a circuit for detecting a key depressed on this keyboard and for generating a key depression data KC indicative of the key being depressed. The key depression data KC is supplied to a tone forming circuit 22 where the data is converted to a musical tone signal corresponding to the depressed key. And, the tone signal generated from the tone forming circuit 22 is supplied, via an output amplifier 24, to a loudspeaker 26 to be converted to audible sounds. Since a print mode signal PM is being supplied, via an inverter 22*a*, to the tone forming circuit 22, the formation of the musical tones is inhibited throughout the printing operation.

The key depression data KC coming from the keyboard circuit 20 is supplied as an input A to a selector 28, and concurrently therewith it is supplied to an OR gate 30 which is arranged to generate a "key-on" signal KON whenever a key on the keyboard is depressed.

The key depression data KC is supplied also to an event detecting circuit 32. This event detecting circuit 32 is constructed to generate an output signal synchronous with each timing of a key depression and a key release, based on the key depression data KC. These output signals are supplied, via an OR gate 34, to a duration data forming circuit 36.

The duration data forming circuit 36 counts clock signals $\phi$ and forms a duration data corresponding to the time interval between the key depression and the key release. The duration data thus formed is supplied to a data rounding-off circuit 37.

The data rounding-off circuit 37 functions so that, when a received duration data is not exactly equal to but is only close to a fourth note duration, it delivers out a duration data as one indicative of the fourth note duration. The duration data which has been subjected to rounding-off processing is supplied, as an input B, to the selector 28.

When starting a keyboard performance, a memory-play-and-print switch MPLP is turned on. Whereupon, in the control signal generating circuit 38 of FIG. 7, an "on" signal "1" of the switch MPLP is delivered out as an action command signal RUN via an OR gate 39. This action command signal RUN renders an auto-rhythm unit 40 to an operable state, so that the auto-rhythm unit 40 automatically generates a rhythm sound signal based on a tempo clock signal coming from a variable tempo generator 42. This rhythm sound signal is supplied to the loudspeaker 26 via the output amplifier 24 to be converted to audible sounds. Accordingly, the player is able to start a keyboard performance in synchronism with the auto-rhythm.

Figure 7:
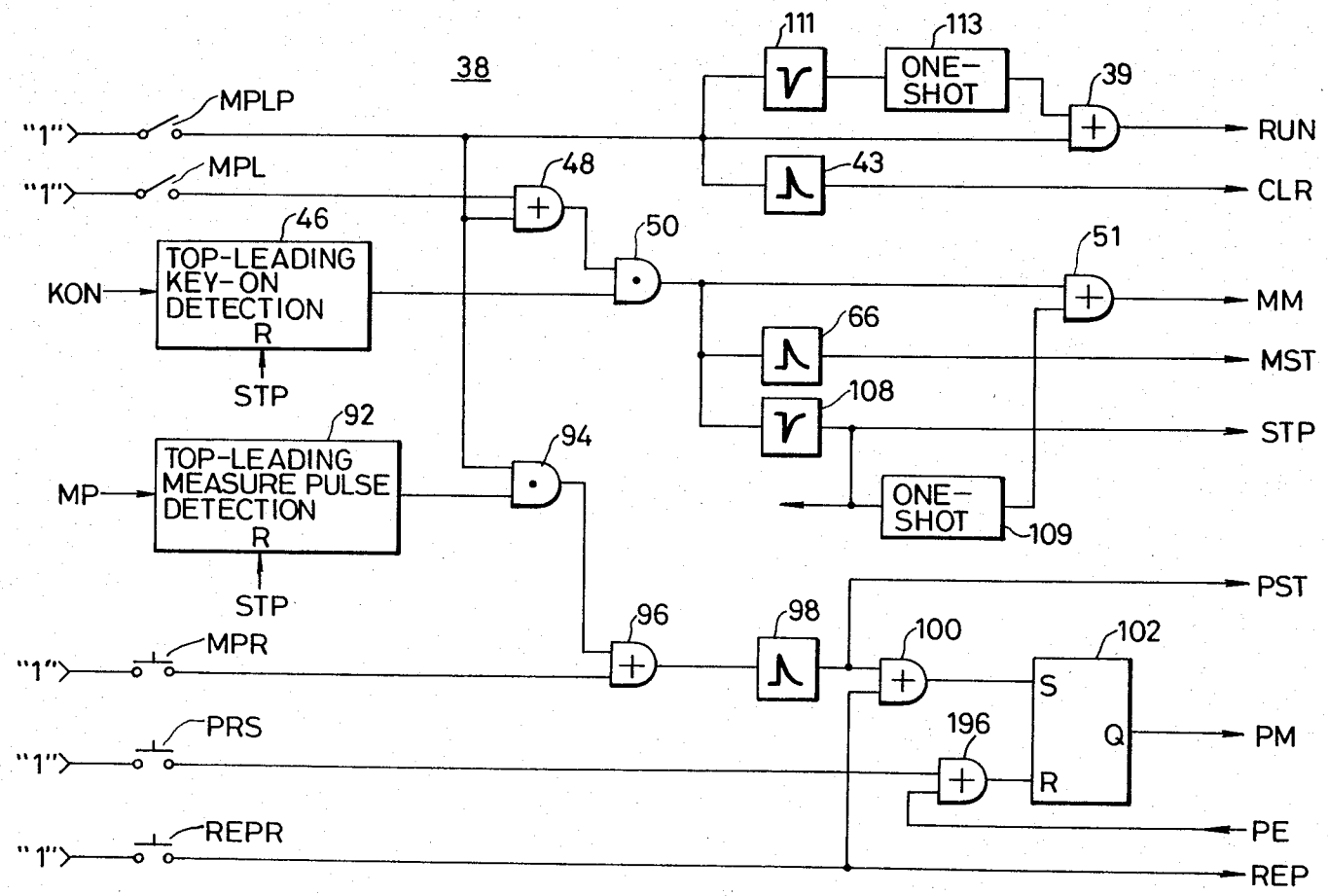
FIG. 7 is a circuit diagram of a control signal generating circuit.

In the control signal generating circuit 38 of FIG. 7, a rise differentiating circuit 43 generates a clear signal CLR based on the "on" operation of the switch MPLP. This clear signal CLR is intended to clear, for example, the memory, the counter or the register. However, for simplicity's sake, the recipient circuits of this signal are omitted in the drawing.

Figure 5A:
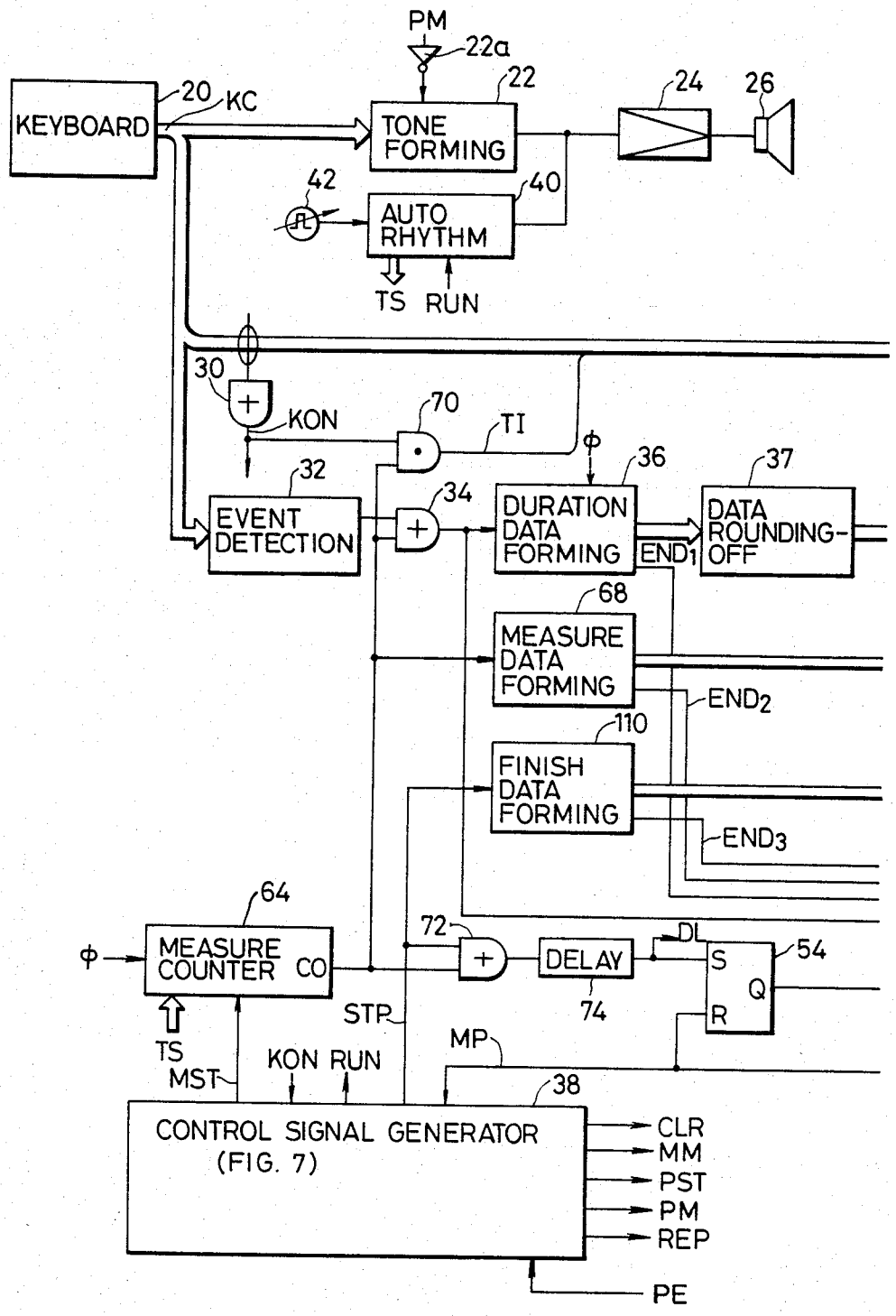
FIGS. 5*a* and 5*b* in combination, and FIG. 6 are circuit diagrams of the abovesaid musical score printing apparatus.

Next, when a keyboard performance is started while taking the tempo from the auto-rhythm sound, there is started an action of writing-in a musical composition data corresponding to the contents of the performance. That is, upon an initial key depression operation, the output signal "1" of the OR gate 34 of FIG. 5*a* is supplied to the selector 28 as a signal SA for selecting the input A. Accordingly, the selector 28 selects the key depression data KC (a pitch data corresponding to the initial key depression) from the keyboard circuit 20, and supplies it to a temporary memory 44 having a storage capacity corresponding to one measure.

On the other hand, in the control signal generating circuit 38 of FIG. 7, a top-leading key-on detecting circuit 46 generates a top-leading key-on detecting signal in accordance with a key-on signal KON coming from the OR gate 30. This top-leading key-on detection signal is supplied, as a memory mode signal MM, to an AND gate 52 of FIG. 5*b* via an AND gate 50 which is in its conducting state due to the "on" signal of the switch MPLP coming from an OR gate 48. At such time, the output Q="0" of a flip-flop 54 renders the AND gate 52 conductive via an inverter 56. Accordingly, the AND gate 52 supplies a write-in command signal W to the temporary memory 44 in accordance with the memory mode signal MM.

The output signal "1" of the OR gate 34 which is generated in response to the initial key depression operation is supplied, as an input A, to a selector 60 via an OR gate 58. Since, at such time, the R-S flip-flop 54 is in its reset state, the selector 60 is in its state of selecting an input A. Accordingly, the output signal of the OR gate 58 is supplied, as a clock input CK, to an address counter 62 via the selector 60. For this reason, the initial pitch data is written in the temporary memory 44 in accordance with the initial address signal coming from the counter 62.

Next, when the duration data forming circuit 36 completes the formation of an initial duration data in synchronism with the initial key release timing, the duration data is supplied, as an input B, to the selector 28 via the data rounding-off circuit 37, and concurrently therewith, a finish signal $END_1$ is generated. This finish signal $END_1$ is supplied to the selector 28 as a signal SB for selecting the input B, and also it is supplied to the counter 62 via the OR gate 58 and the selector 60. For this reason, the initial duration data is written in the temporary memory 44 in a manner similar to that for the aforesaid initial pitch data.

Thereafter, a pitch data and a duration data corresponding to the respective key depressions subsequent to the second key depression are written in the temporary memory 44 in a manner similar to that described above. With respect to the "rest", a pitch data wherein all the bits other than the mark bit are "0" and a duration data corresponding to the rest duration are written in the temporary memory 44.

When the end of the 1st measure comes, a measure counter 64 generates a carry-out signal CO. This measure counter 64 is intended to start the counting of clock signals $\phi$ in accordance with the memory start signal MST which is obtained by differentiating the rise of the output signal of the AND gate 50 of FIG. 7 by a differentiating circuit 66. This counter is arranged so that the frequency dividing ratio is set in accordance with a beat setting signal coming from the auto-rhythm unit 40. That is, when a specific rhythm is selected by the auto-rhythm unit 40, a beat setting signal TS corresponding to the beat of the selected rhythm is supplied to the measure counter 64. Accordingly, arrangement is made so that the measure counter 64 generates a carry-out signal CO at every end of measures with a cycle corresponding to the beat which has been set.

The carry-out signal CO coming from the counter 64 is supplied to a measure data forming circuit 68. In accordance therewith, the measure data forming circuit 68 forms a measure data indicative of the end of the measure, and supplies it to the selector 28 as an input C. And, the measure data forming circuit 68, upon its completion of the measure formation processing, generates a finish signal $END_2$. This finish signal $END_2$ is supplied to the selector 28 as a signal SC intended for selecting the input C, and also is supplied to the counter 62 via the OR gate 58 and the selector 60. Accordingly, the measure data is written in the temporary memory 44.

When a key depression is performed on the keyboard at the time the counter 64 generates a carry-out signal CO, the OR gate 30 outputs a key-on signal KON, rendering an AND gate 70 conductive. Therefore, the AND gate 70 supplies a tie signal TI, as an input A, to the selector 28 in accordance with the carry-out signal CO. Also, the carry-out signal CO at such time is supplied to the OR gate 34 to serve as a sort of key release timing signal. Accordingly, the final pitch data and duration data of the 1st measure are written successively in the temporary memory 44, and thereafter the measure data is written therein. The measure data forming circuit 68 for enabling such operations as mentioned above is so arranged that it commences a data forming action with a slight delay from the time of generation of the carry-out signal CO. The pitch data which has been written in as mentioned above contains a tie signal TI. Accordingly, at the time of printing, the final note of the 1st measure and the initial note of the 2nd measure are combined together by the tie.

On the other hand, the carry-out signal CO coming from the counter 64 sets the flip-flop 54 via an OR gate 72 and a delay circuit 74. For this reason, the output Q="1" of the flip-flop 54 is supplied, as a read-out command signal RE, to the temporary memory 44 via an AND gate 76 which has been rendered conductive by the memory mode signal MM. Also, the output Q="1" of the flip-flop 54 is supplied to the selector 60 as a signal SB for selecting an input B, and accordingly, the selector 60 selects a clock signal $\phi$ and supplies it to the counter 62. This counter 62 is arranged so that it is reset when an OR gate 78 outputs an output signal corresponding to an output signal DL of the delay circuit 74. This counter counts the clock signals $\phi$ coming from the selector 60 which has been thus reset, and supplies a reading-out address signal to the temporary memory 44. As a result, a musical composition data for one measure is read out from the temporary memory 44, and it is supplied to a principal memory 80.

Also, the output Q="1" of the flip-flop 54 is supplied, as a write-in command signal W, to the principal memory 80 via an AND gate 82 which has been rendered conductive by the memory mode signal MM, and concurrently it renders an AND gate 84 conductive. For this reason, the AND gate 84 will supply a clock signal $\phi$ to the writing-in address counter 86 which, in turn, counts clock signals $\phi$ and supplies, as an input A, a writing-in address signal to a selector 88. At such time, the selector 88 is in its state of selecting the input A in accordance with the output Q="1" of the flip-flop 54, and accordingly the writing-in address signal from the counter 86 is supplied to the principal memory 80 via the selector 88.

Accordingly, the musical score data for one measure which is read out from the temporary memory 44 is written successively in the principal memory 80, and thus a high-speed data transmission is carried out from the temporary memory 44 over to the principal memory 80.

In such data transmission, the data correction circuit which is contained in the principal memory 80 performs such a duration data correction processing as will enable a musically adequate printing (see FIG. 4*b*) in accordance with the operation command signal RUN coming from an OR gate 80*a*. The data which has been subjected to this processing is written in the memory section of the principal memory 80.

In the data transmission mentioned above, there is read out from the temporary memory 44 a measure data for the 1st measure at the end of the transmitted data. When this measure data is supplied to a measure termination detecting circuit 90, this latter circuit 90 generates an initial measure pulse signal MP. This measure pulse signal MP resets the flip-flop 54, and accordingly the selector 60 is rendered to its state of selecting an input A, and thus the temporary memory 44 is rendered to its write-in mode.

Also, in the circuit shown in FIG. 7, a top-leading measure pulse detecting circuit 92 generates a detection signal in accordance with the initial measure pulse signal MP. This detection signal is supplied to a rise differentiating circuit 98 via an AND gate 94 which has been rendered conductive by an "on" signal of the switch MPLP and further via an OR gate 96, to be converted to a differentiation pulse signal. This differentiation pulse signal is delivered out as a print start signal PST, and concurrently it sets an R-S flip-flop 102 via an OR gate 100. As a result, the flip-flop 102 generates a print mode signal PM which is comprised of an output Q="1".

Figure 5B:
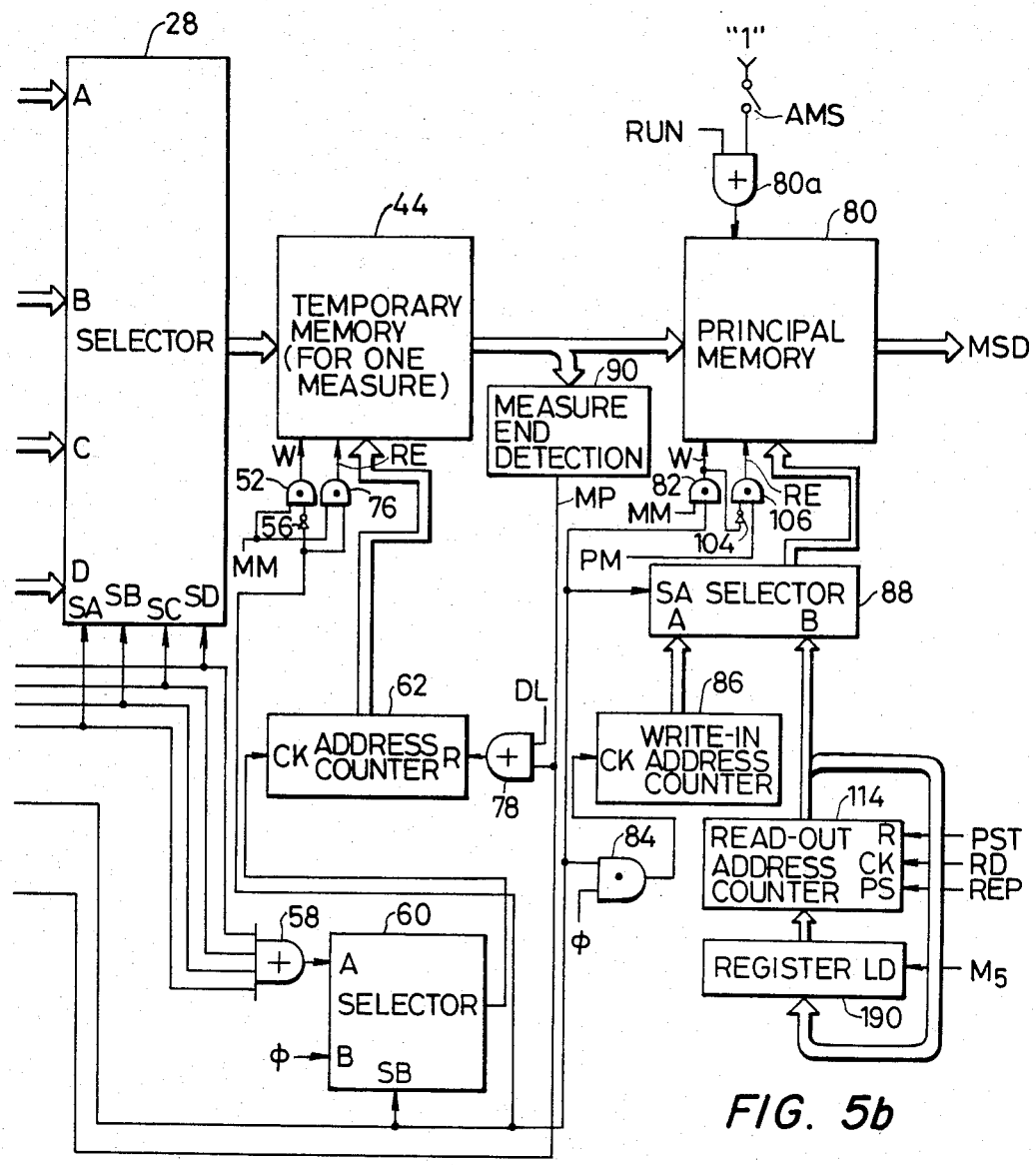

On the other hand, the AND gate 82 of FIG. 5*b* provides an output signal which is "0" in accordance with the resetting of the flip-flop 54. This output signal renders an AND gate 106 conductive via an inverter 104. As a result, when a print mode signal PM is supplied from the flip-flop 102 of FIG. 7 to the AND gate 106, this latter AND gate 106 will supply a read-out command signal RE to the principal memory 80. Also, the AND gate 84 becomes non-conductive due to the output Q="0" of the flip-flop 54, and the selector 88 is rendered to its state of selecting an input B by the output Q="0" of the flip-flop 54. The measure pulse signal MP resets the counter 62 via the OR gate 78.

After the abovesaid transmission of the musical score data of one measure, a musical score printing operation is started by reading out the musical score data successively. This operation will be described later. And, in the circuit of FIGS. 5*a* and 5*b*, as the keyboard performance progresses, a musical score data is written in the temporary memory 44 measure by measure for the 2nd measure and subsequent measures in a manner same as that described above. And, concurrently therewith, at each time the musical score data for one measure is written in the temporary memory 44, the written-in data is transmitted at a high speed to the principal memory 80.

Let us now assume that the keyboard performance is ceased after such operation is repeated for a plural number of measures, for example at the end of the 8th measure. The player will turn off the memory-play-and-print switch MPLP. Whereupon, the output signal of the AND gate 50 in the circuit of FIG. 7 becomes "0". Accordingly, a fall differentiating circuit 108 which uses said output signal "0" as its input will generate a stop signal STP. This stop signal STP resets both detecting circuits 46 and 92, and on the other hand, it is supplied to a finish data forming circuit 110 of FIG. 5*a*. Also, the stop signal STP is converted to a pulse signal of a predetermined width at a one-shot multivibrator circuit 109 which is provided to enable the transmission of the musical score data of the final measure. This pulse signal is delivered out as a memory mode signal MM via the OR gate 51. It should be understood here that a fall differentiating circuit 111 which uses, as its input, a state-indicating signal of the switch MPLP is provided, along with a one-shot multivibrator circuit 113, to enable the duration data correction processing of the final measure. A pulse signal of a predetermined width coming from said one-shot circuit 113 is delivered out as an operation command signal RUN via the OR gate 39.

The finish data forming circuit 110 forms a finish data based on the stop signal STP, and supplies it, as an input D, to the selector 28, and concurrently therewith, generates a finish signal $END_3$ at the time of completion of the data formation. This finish signal $END_3$ is supplied to the selector 28 as a signal SD for selecting an input D, and also it is supplied to the counter 62 via the OR gate 58 and the selector 60. As a result, a finish data is written in the temporary memory 44.

The stop signal STP also sets the flip-flop 54 via the OR gate 72 and the delay circuit 74. As a result, in a same way as for the abovesaid completion of the measure, the musical composition data of the final measure is transmitted at a high speed from the temporary memory 44 to the principal memory 80. In such an instance, when finish data which is read out finally from the temporary memory 44 is supplied to the measure termination detecting circuit 90, this circuit 90 generates a measure pulse signal MP. This measure pulse signal MP resets the flip-flop 54, and also rests the counter 62 via the OR gate 78. When the flip-flop 54 is reset, the principal memory 80 is rendered to its reading-out mode in the same manner as described above, rendering the AND gate 84 to its non-conductive state, and thus the selector 88 is plunged to its state of selecting an input B.

When the memory-play-and-print switdh MPLP is turned off, the operation command signal RUN becomes "0" after the lapse of the duration time of the output pulse of the one-shot multivibrator circuit 113, starting at said turned-off time. As a result, the sounding of the rhythm sound by the auto-rhythm unit 40 of FIG. 5*a* is suspended.

Next, the musical composition printing operation will be described. As stated above, an initial measure pulse signal MP is generated from the measure termination detecting circuit 90 at the time that the musical score data of the 1st measure has been transmitted to the principal memory 80. In response thereto, the control signal generating circuit 38 of FIG. 7 generates a print start signal PST and a print mode signal PM. In accordance with the generation of these print start signal PST and print mode signal PM, a substantial musical score printing operation is commenced. However, since the tonality signature of the initial measure is printed at the time the tonality is set, description will be made first with respect to a data generating circuit 112 which includes a tonality setting means. This data generating circuit 112 is intended to generate a print-and-paper-feed data for tonality signatures, and as an example, it has such an arrangement as shown in FIG. 8.

Figure 8:
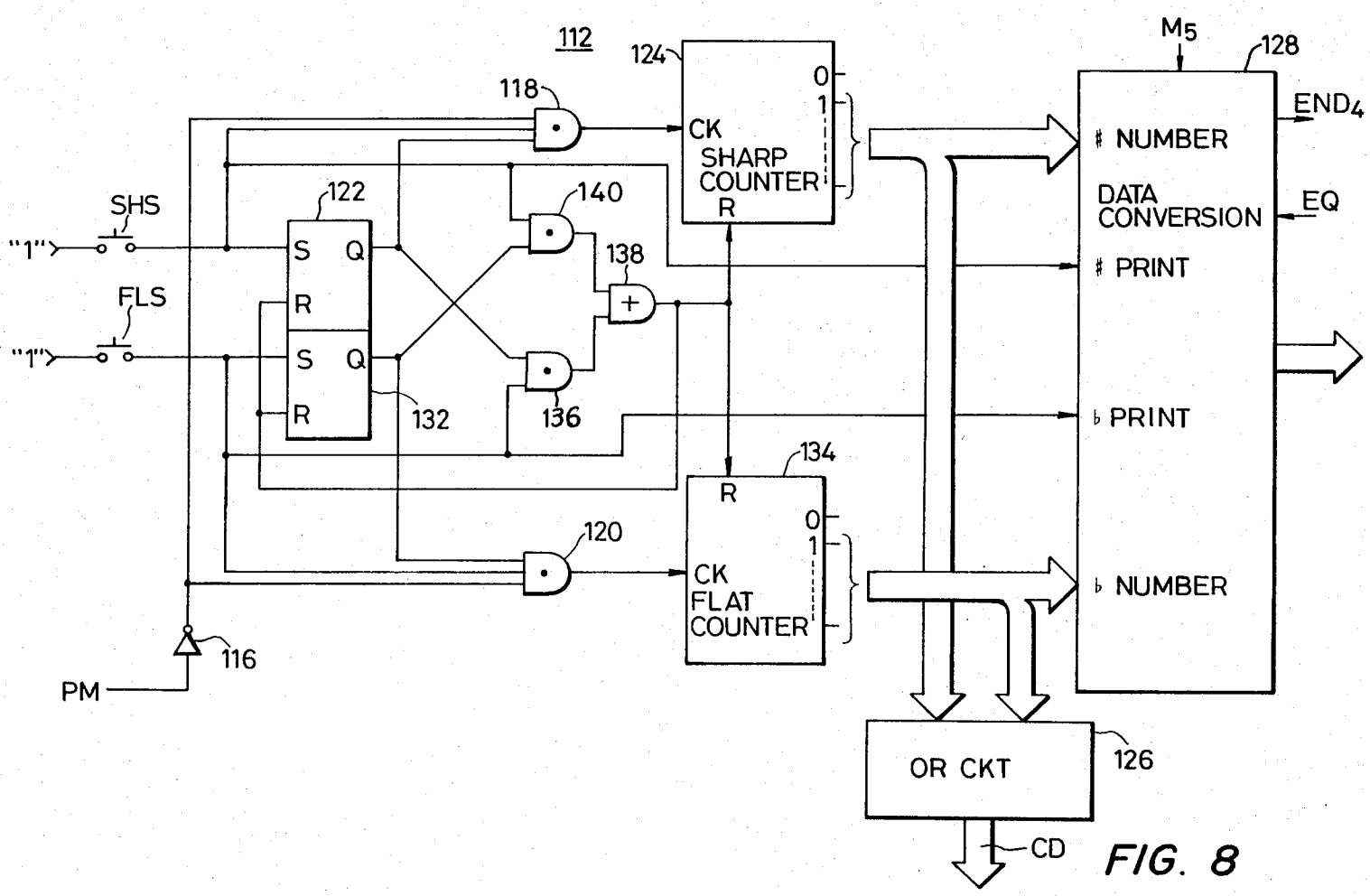
FIG. 8 is a circuit diagram of a print-and-paper-feed data generating circuit for tonality signatures.
Figure 9:
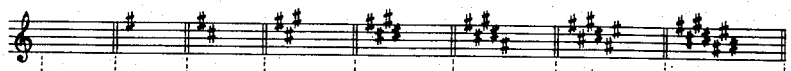
FIG. 9 is an illustration showing tonality signatures of various sharp family tonalities and flat family tonalities.
Figure 9:
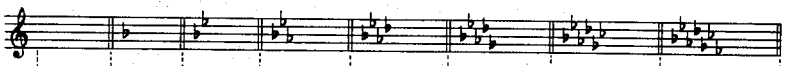

In the circuit of FIG. 8, the setting of a tonality is carried out usually by using the tonality setting switch SHS or FLS prior to starting a performance or during the suspension of printing. That is, an inverter 116 which uses, as its input, a print mode signal PM renders AND gates 118 and 120 conductive during the non-print mode. Accordingly, the setting of various tonalities of sharp family and flat family as shown in FIG. 9 becomes possible by using the switch SHS or FLS.

Here, in case the tonality is now at C major wherein an R-S flip-flop 122 is reset, in order to set a tonality among the sharp family, it is only necessary to manipulate or depress the tonality setting switch SHS for sharp family a number of times corresponding to the required number of sharps. For example, when the switch SHS is depressed once, this causes the flip-flop 122 to be set. The AND gate 118 which uses, as its input, an output Q="1" of the flip-flop supplies the "on" signal of the switch SHS to a sharp counter 124. Accordingly, the counter 124 advances by one (1) count, and supplies its count data to an OR circuit 126. Concurrently therewith, the counter supplies a signal, as a sharp number designating signal, to a data converting circuit 128 which includes such circuits as a ROM (Read Only Memory). At such time, an "on" signal of the switch SHS is supplied, as a sharp print command signal, to the data converting circuit 128. And, the sharp number designating signal and the sharp print command signal which have been supplied to the data converting circuit 128 are converted to a print-and-paper-feed data for the sake of sharp signatures, and it is delivered out.

On the other hand, in case the tonality is now at C major wherein an R-S flip-flop 132 is reset, in order to carry out a setting of a tonality among the flat family, it is only necessary to depress the tonality setting switch FLS for flat family in a number of times corresponding to the required number of flats. For example, when the switch FLS is depressed once, the flip-flop 132 is set, and the AND gate 120 which uses, as its input, the output Q="1" of the flip-flop will supply an "on" signal of the switch FLS to a flat counter 134. As a result, this counter 134 advances by one (1) count, and supplies its count data to the OR gate 126, and at the same time supplies the data as a flat number designating signal to the data converting circuit 128. At such time, an "on" signal of the switch FLS is supplied, as a flat print command signal, to the data converting circuit 128. And, the flat number designating signal and the flat print command signal which have been supplied to the data converting circuit 128 are converted to a print-and-paper-feed data for flat signatures, and is delivered out.

Here, in order to alter the setting of either one of the sharp family tonalities and the flat family tonalities to another tonality, it is only necessary to set back to C major once and then to set the intended one. That is, in order to alter the tonality of sharp family to the tonality of flat family, the switch FLS is first depressed once. Whereupon, an output signal "1" is generated from an AND gate 136, and this signal resets, via an OR gate 138, the flip-flops 122 and 132 and also the counters 124 and 134. This state represents that the tonality has now been set back to C major. Accordingly, it is only necessary thereafter to depress the switch FLS in a required number of times. Also, in order to alter the tonality of flat family to a tonality of sharp family, the switch SHS is first depressed once. Whereupon, an output "1" is generated from an AND gate 140. This signal resets, via the OR gate 138, the flip-flops 122 and 132 and also the counters 124 and 134. This state represents that the tonality has now been set back to C major, and thereafter it is only necessary to depress the switch SHS in a required number of times.

In such a manner as described above, the print-and-paper-feed data which is delivered out from the data converting circuit 128 in correspondence to the set tonality is supplied to a printer 144 via an OR circuit 142.

Among the print-and-paper-feed data which is supplied to the printer 144, the print data is supplied to a print controlling circuit 146, whereas the paper-feed data is supplied to a paper-feed controlling circuit 148. When print-and-paper-feed controlling is carried out in such manner as indicated by a received data, the print controlling circuit 146 and the paper-feed controlling circuit 148 generate coincidence signals EQ, respectively. These coincidence signals EQ are supplied, via an OR gate 150, to the data generating circuit 112. In response therewith, the data generating circuit 112 generates the following data. And, by the repetition of such operations as mentioned above, a tonality signature of the initial measure is printed out on the printing sheet. However, in case the tonality of the 1st measure is C major, no sharp or flat signature is printed out.

Upon completion of the above-mentioned printing operations, the data generating circuit 112 generates a finish signal $END_4$. This finish signal $END_4$ is supplied to an AND gate 152, to render it conductive.

When subsequently, the abovesaid print start signal PST and print mode signal PM are generated, the print start signal PST resets the reading-out address counter 114 of FIG. 5*b*, whereas the print mode signal PM is supplied to a data generating circuit 156 via an OR gate 154 and the AND gate 152. The data generating circuit 156 is intended to generate a print-and-paper-feed data for a clef sign, a time signature, staff lines and bar lines. This circuit 156 contains such items as a ROM, and is arranged so that, when it receives an output signal of the AND gate 152 corresponding to the print mode signal PM, it supplies a print-and-paper-feed data to the printer 144 via the OR circuit 142. In such an instance, the print-and-paper-feed data for time signatures which is delivered out is such one as corresponding to a time setting signal TS coming from the auto-rhythm unit 40 of FIG. 5*a*.

The print-and-paper-feed data delivered out from the data generating circuit 156 is supplied to the printer 144 via the OR circuit 142. Accordingly, the printer 144 prints staff lines, bar lines, a clef sign and a time signature in the same way as for the printing of the tonality signature which has been described above. And, upon completion of these operations, the data generating circuit 156 generates a finish signal $END_5$.

This finish signal $END_5$ is supplied as a read-out controlling signal RD to the reading-out address counter 114 of FIG. 5*b* via OR gates 158, 160, 162 and 164. In response thereto, the counter 114 generates an initial reading-out address signal. This reading-out address signal is supplied to the principal memory 80 via the selector 88 which is in its state of selecting an input B. Accordingly, an initial pitch data serving as a musical composition data MSD is read out from the principal memory 80.

Figure 6:
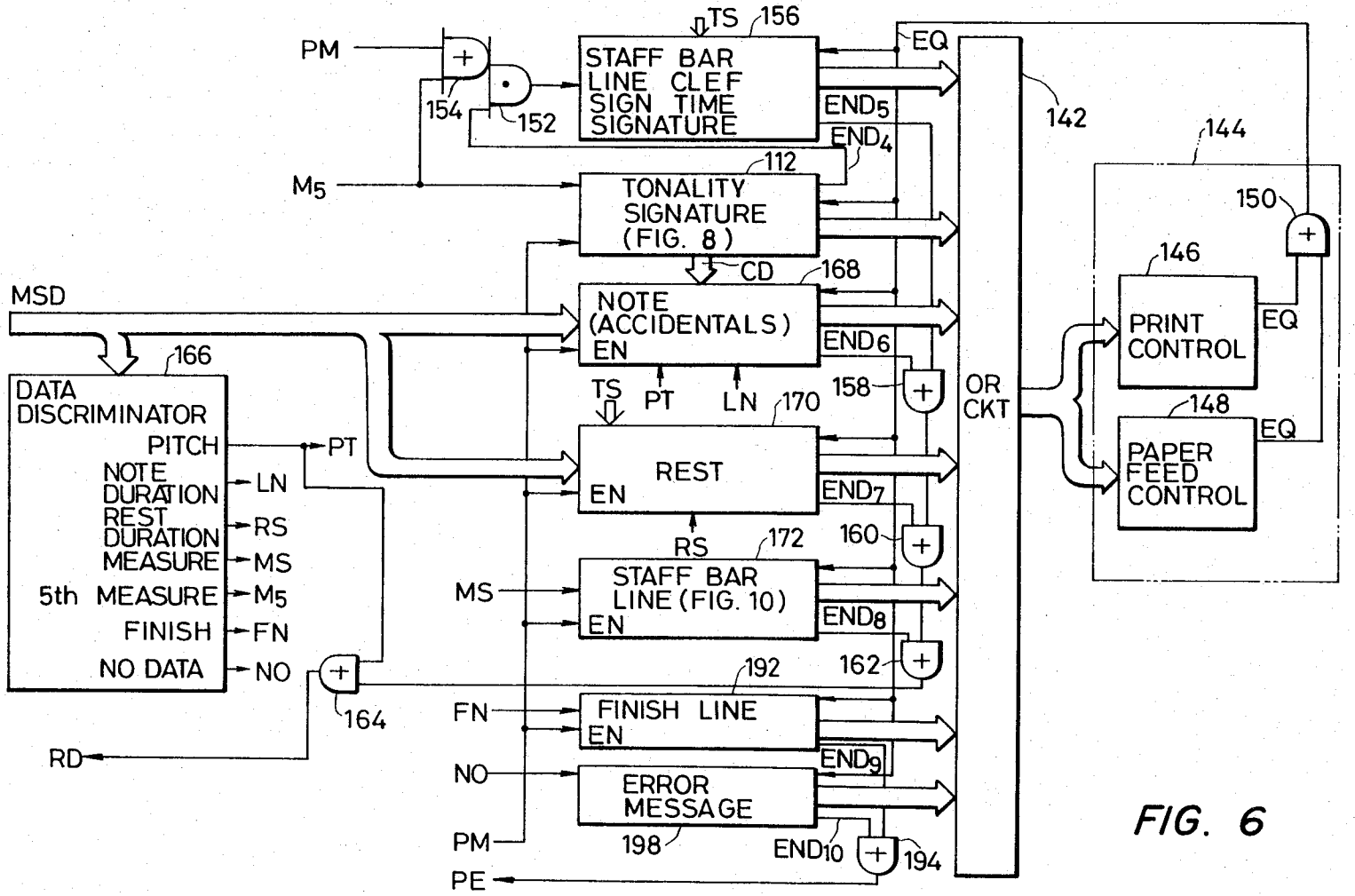

The pitch data which is thus read out is supplied to a data discriminating circuit 166 and also to a data generating circuit 168 of FIG. 6. The data generating circuit 168 is intended to generate a print-and-paper-feed data for notes (including such accidentals as sharps, flats, naturals and ties), and contains such circuits as a latch circuit and a ROM. This data generating circuit 168 is arranged to receive, from the OR circuit 126 of the data generating circuit 112, a control data CD for controlling the addition of sharps, flats and naturals.

When the data discriminating circuit 166 generates an initial pitch data detection signal PT in accordance with the initial pitch data, the data generating circuit 168 latches the initial pitch data in accordance with this signal PT. Also, the initial pitch data detection signal PT is supplied via the OR gate 164 to the counter 114 of FIG. 5. Accordingly, an initial duration data is read out from the principal memory 80.

The data discriminating circuit 166 generates an initial duration data detection signal LN in accordance with the initial duration data. Accordingly, the data generating circuit 168 latches the initial duration in accordance with said signal LN. And, the data generating circuit 168 generates a print-and-paper-feed data for the initial note based on the latched pitch data and duration data. Since this print-and-paper-feed data is supplied to the printer 144 via the OR circuit 142, an initial note is printed out on the staff lines which have been printed out already on the printing sheet.

Upon completion of the printing of the first note, the data generating circuit 168 generates a finish signal $END_6$. This finish signal $END_6$ is supplied to the counter 114 of FIG. 5*b* via the OR gates 158, 160, 162 and 164. Accordingly, the second pitch data and duration data are read out successively from the principal memory 80 in a manner similar to that described previously. And, the data generating circuit 168 generates a print-and-paper-feed data in the same fashion as described before based on the second pitch data and duration data, and accordingly the printing of the second note becomes feasible. Subsequently, in like manner, pitch data and duration data are read out from the principal memory 80, and thus the operation of printing notes is repeated.

Here, let us assume that a pitch data corresponding to a rest is read out from the principal memory 80. In succession to this reading-out, there is read out a rest duration data. The data discriminating circuit 166 generates a rest duration data detection signal RS in accordance with the rest duration data. In response to this signal RS, a data generating circuit 170 latches the rest duration data. The data generating circuit 170 is intended to generate a print-and-paper-feed data for rests, and contains such circuits as a latch circuit and a ROM. The rest duration data which is latched by the data generating circuit 170 causes the generation of a print-and-paper-feed data which is necessary for depicting a corresponding rest. And, this data is supplied to the printer 144 via the OR circuit 142. Thus, a rest is printed out on the score lines on the printing sheet.

When the printing of the rest is completed, the data generating circuit 170 generates a finish signal $END_7$. This finish signal $END_7$ is supplied to the counter 114 of FIG. 5*b* via the OR gates 160, 162 and 164, so that a next data is read out from the principal memory 80.

As the printing operation of either a note or a rest progresses in such a way as described above, an initial measure data will be read out from the principal memory 80. In response thereto, the data discriminating circuit 166 generates a measure data detection signal MS to deliver it to a data generating circuit 172.

Figure 10:
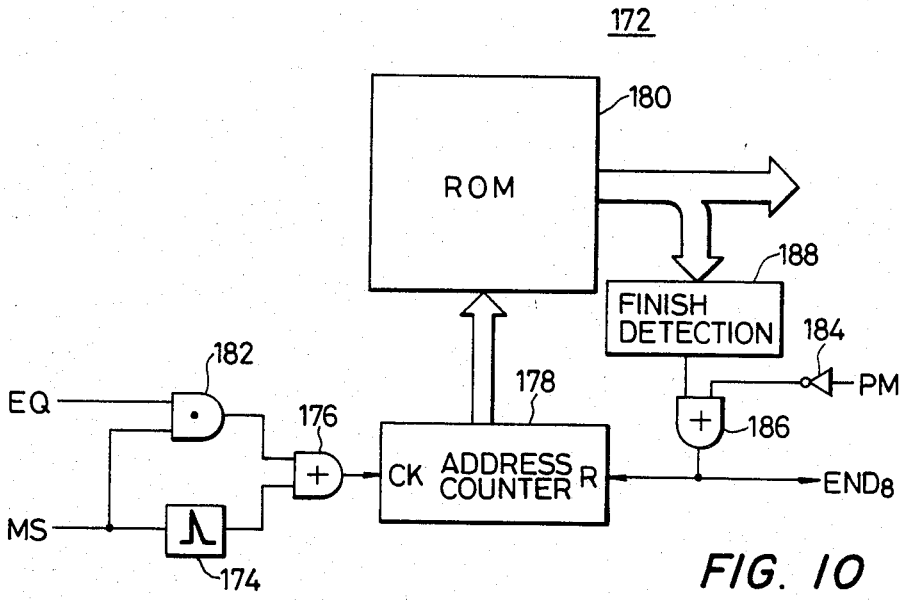
FIG. 10 is a circuit diagram for the print-and-paper-feed data generating circuit for printing out staff lines and bar lines.

The data generating circuit 172 is intended to generate a print-and-paper-feed data for both staff lines and bar lines. As an example, it is of the arrangement as shown in FIG. 10. That is, the measure data detection signal MS is subjected to a rise differentiation by a differentiating circuit 174. A differentiation output pulse delivered from the differentiating circuit 174 is supplied to an address counter 178 via an OR gate 176. As a result, an initial print-and-paper-feed data is read out from a print-and-paper-feed data ROM 180 in accordance with an initial reading-out address signal. And, when print-and-paper-feed controlling corresponding to the read-out data is carried out in such a manner as described above, a coincidence signal EQ is supplied from the OR gate 150 of FIG. 6 to an AND gate 182.

This coincidence signal EQ is supplied to the counter 178 via the AND gate 182 which has been rendered to its conducting state by the measure data detection signal MS and further via the OR gate 176. As a result, data which is necessary for a next controlling operation is read out from the ROM 180. And, after subsequent repetitions of similar operations, the bar line at the end of the 1st measure (i.e. the bar line for the beginning of the 2nd measure) and the staff lines for the 2nd measure are printed out. Also, since an arrangement is provided so that an output signal of an inverter 184 which receives a print mode signal PM as its input is supplied to the counter 178 as a reset signal, there is not carried out the reading-out of a data from the ROM 180 at the time of non-print mode wherein the print mode signal PM becomes "0".

Finish data is read out finally from the ROM 180. In response thereto, a finish detecting circuit 188 generates a finish detection signal. This finish detection signal is delivered out, as a finish signal $END_8$, via an OR gate 186. This finish signal $END_8$ resets the counter 178, and concurrently it is supplied to the counter 114 of FIG. 5*b* via the OR gates 162 and 164 of FIG. 6. As a result, a musical score data for the 2nd measure is read out from the principal memory 80. In response thereto, there is carried out the operation of printing out the musical score for the 2nd measure. It should be understood here that, as the data generating circuit 172, the print-and-paper-feed data generating section for staff lines and bar lines contained in the abovesaid data generating circuit 156 may be utilized.

Thereafter, the printing operations of musical scores for the 3rd measure and thereafter for the 4th measure are carried out in the same manner as stated above. And, when a measure data is read out from the principal memory 80 at the end of the 4th measure as shown in FIGS. 4*a* and 4*b*, the data discriminating circuit 166 which has been counting the measure number generates a detection signal $M_5$ indicative of the beginning of the 5th measure. This detection signal $M_5$ is supplied to the data converting circuit 128 in the data generating circuit 112 of FIG. 8. In response thereto, this data converting circuit 128 delivers out a print-and-paper-feed data for tonality signatures. Accordingly, there is carried out the printing of the initial tonality signature at the beginning of the 5th measure, but in case the tonality is C major, the printing of this tonality signature is not carried out. And, upon completion of this tonality signature printing, i.e. in case of C major, it means that when a detection signal $M_5$ is received, the data generating circuit 112 generates a finish signal $END_4$. Accordingly, in response thereto, the data generating circuit 156 delivers out a print-and-paper-feed data to enable the bar line at the beginning of the 5th measure as well as the staff lines and the clef sign for the 5th measure to be printed out.

On the other hand, the detection signal $M_5$ is supplied, as a load command signal LD, to a register 190 of FIG. 5*b*. Accordingly, the register 190 is loaded with a reading-out address signal corresponding to the initial bar line data of the 5th measure. This reading-out address signal is preset in the counter 114 in accordance with a re-print command signal REP as will be described later.

When, subsequently, the data generating circuit 156 generates a finish signal $END_5$, this signal $END_5$ is supplied to the counter 114 of FIG. 5*b* via the OR gates 158, 160, 162 and 164 of FIG. 6. As a result, a musical score data of the 5th measure is read out from the principal memory 80. In response thereto, a musical score printing operation same as described above is carried out. And, with respect to the 6th to 8th measures also, similar printing operations are carried out.

When, thereafter, a finish data is read out from the principal memory 80 at the end of the 8th measure, the data discriminating circuit 166 generates a finish data detection signal FN to be delivered to a data generating circuit 192. This data generating circuit 192 is intended to generate a print-and-paper-feed data for a finish line in accordance with the finish data detection signal FN, and includes such circuits as a ROM. The print-and-paper-feed data coming from the data generating circuit 192 is supplied, via the OR circuit 142, to the printer 144. Thus, a finish line is printed out on the printing sheet.

Upon completion of the printing of the finish line, the data generating circuit 192 generates a finish signal $END_9$. This finish signal $END_9$ is supplied, as a print end signal PE, to an OR gate 196 of FIG. 7 via an OR gate 194. In response thereto, an output signal of the OR gate 196 resets the flip-flop 102, causing the print mode signal PM to become "0". As a result, the operations of the respective data generating circuits 112, 156, 168, 170, 172 and 192 are suspended, and with this a series of printing operations complete.

In the abovesaid print mode operation, let us now suppose that the print stop switch PRS of FIG. 7 is depressed in the midst of the 6th measure of FIG. 4*b*. The "on" signal of the switch PRS resets the flip-flop 102 via the OR gate 196. As a result, the print mode signal PM becomes "0", and in a same manner as described above with respect to the termination of printing, the printing operation comes to a halt.

Thereafter, it is possible to set, as required, a tonality for the purpose of changing the already set tonality. After that, the re-print command switch REPR of FIG. 7 is depressed to resume the printing operation. Whereupon, the "on" signal of this switch sets the flip-flop 102 via the OR gate 100. Accordingly, the print mode signal PM becomes "1". And, the data generating circuits 112, 156, 168, 170, 172 and 192 are enabled. Also, the "on" signal of the switch REPR is delivered out as a re-print command signal REP, and is supplied, as a present command signal PS, to the counter 114 of FIG. 5*b*. As a result, a reading-out address signal corresponding to the bar line data at the beginning of the 5th measure is preset in the counter 114 from the register 190, and a bar line data at the beginning of the 5th measure is read out from the principal memory 80. As a result, in the same way as described above, the printing operation is resumed at the initial bar line of the 5th measure. In this instance, a detection signal $M_5$ is generated, so that, prior to the printing of the bar line at the beginning of the 5th measure and other items, a tonality signature, if other than C major, is printed out. The tonality signature which is printed out at such time is exactly the same as the preceding one unless changed, and if changed, it will be the signature of the tonality after the transition.

The above description concerns the memory play and print mode operation acquired by depressing the memory play and print switch MPLP in FIG. 7. In case, however, the memory play switch MPL is depressed in place of the switch MPLP, operations up to the stage that a musical score data corresponding to the contents of performance is stored in the principal memory 80, are carried out in the same manner as described above. In such an instance, when a correction switch AMS of FIG. 5*b* is turned on, the "on" signal of this switch AMS is supplied to the correction circuit of the principal memory 80 via the OR gate 80*a*. In response thereto, the correction of a duration data is carried out also. In case the memory print switch MPR is depressed, the operations to read out a musical score data from the principal memory 80 and to print it out are carried out in a manner as described above.

In case, however, the print mode has been set, but there is no data to be read out from the principal memory 80, the data discrimination circuit 166 of FIG. 6 detects the absence of data, and supplies a detection signal NO of such an effect to an error message circuit 198. Accordingly, the error message circuit 198 supplies a print-and-paper-feed data which is necessary for printing out "NO DATA" to the printer 144 via the OR circuit 142, and thus "NO DATA" is printed out on the printing sheet.

Description has been made above of embodiments dealing mainly with a melody. It should be understood that the present invention can be equally effectively carried out on chords also (see FIGS. 4*a* and 4*b*). Also, a melody and chords may be recorded independently of each other. In case it is intended to do so, programming may be made so that, in case there is lack of matching in beat between the melody and the chord in question, an error message to such an effect may be produced. Also, the duration data correction circuit which is contained in the principal memory 80 may be arranged to function at the time of reading out instead of prior to storing. In case it is so arranged as stated just above, the correction switch AMS may be depressed as required at the time the memory print switch MPR is turned on.

In the above-described embodiments, arrangement is made so that the measure number is counted to automatically load the read-out address on the register. It is, however, possible to provide such an arrangement which permits a desired measure to be set manually, and to load the read-out address corresponding to the set measure on the register.

What is claimed is:

1. An apparatus for printing out graphical patterns, comprising:

means for successively receiving a data signal representing consecutive discrete blocks of graphical patterns;

memory means connected to the receiving means to store a data portion contained in said data signal and constituting at least one of said discrete blocks of graphical patterns;

read-out means connected to said memory means to timewisely successively read out said data portion stored in said memory means;

printing means connected to said read-out means to timewisely successively print out a graphical pattern on a recording sheet in accordance with the data portion being read out from said memory means;

first controlling means connected to said read-out means and to said printing means to suspend the print-out operation at a point midway of one of said discrete blocks of graphical pattern;

resumption commanding means to command to resume the suspended printing-out operation; and second controlling means connected to said resumption commanding means, to said read-out means and to said printing means to cause to resume the print-out operation at least from the beginning of said discrete block of graphical pattern containing said point at which the print-out operation has been suspended, in accordance with a resumption command delivered from said resumption commanding means.

2. An apparatus according to claim 1, in which:

said print resumption commanding means has means to designate a print resuming position.

3. An apparatus for printing out a musical score, comprising:

means for successively receiving a data signal representing consecutive measure blocks of a musical score, each measure blocks including at least one measure;

memory means connected to the receiving means to store a data portion contained in said data signal and constituting at least one of the measure blocks contained in said data signal;

read-out means connected to said memory means to timewisely successively read out said data portion stored in said memory means;

printing means connected to said read-out means to timewisely successively print out said musical score on a recording sheet in accordance with the data portion being read out from said memory means;

first controlling means connected to said read-out means and to said printing means to suspend the print-out operation at a point midway of one of said consecutive measure blocks of a musical score;

resumption commanding means to command to resume the suspended print-out operation; and second controlling means connected to said resumption commanding means, to said read-out means and to said printing means to cause to resume the printing-out operation at least from the beginning of said measure block containing said point at which the printing-out operation has been suspended, in accordance with a resumption command delivered from said resumption commanding means.

4. An apparatus according to claim 3, in which:

said resumption commanding means has means to designate a measure from which the printing-out operation is to be resumed.

5. An apparatus for printing out a musical score, comprising:

memory means for storing a musical score data consisting of data for a plurality of blocks of measures;

read-out means connected to said memory means to successively read out said musical score data from said memory means;

converting means connected to said read-out means for converting the musical score data read out from said memory means to a musical score printing and paper feeding data;

printing means connected to said converting means for printing out a musical score on a printing sheet based on said musical score printing and paper feeding data delivered from said converting means;

stopping means connected to said read-out means and said printing means to stop their read-out and printing-out operations;

resumption commanding means connected to said read-out means and to said printing means to cause them to resume their suspended read-out and printing-out operations; and read-out resumption position designating means connected to said memory means and to said resumption commanding means to designate the beginning of a measure in the musical score data whose printing has been suspended at a point midway of said measure of the musical score, said read-out resumption position designating means being connected to said read-out means and to said printing means to cause them to resume their read-out and print-out operations at a designated read-out resumption position in accordance with a reprint command delivered from the resumption commanding means after a suspension of the read-out and print-out operations.

6. An apparatus according to claim 5, in which:

said read-out resumption position designating means designates the beginning of a block containing a measure in the musical score data whose printing has been suspended at a point midway of this measure.

* * * * *